United States Patent [19]

Grosso et al.

[11] Patent Number: 4,878,206

[45] Date of Patent: Oct. 31, 1989

[54] METHOD AND APPARATUS FOR FILTERING NOISE FROM DATA SIGNALS

[75] Inventors: Donald S. Grosso, West Hartford; Thomas M. Bryant, Avon; Mitchell S. Gershonowitz, Wallingford, all of Conn.

[73] Assignee: Teleco Oilfield Services Inc., Meriden, Conn.

[21] Appl. No.: 290,506

[22] Filed: Dec. 27, 1988

[51] Int. Cl.[4] ..... G01V 1/40

[52] U.S. Cl. ..... 367/83; 367/43

[58] Field of Search ..... 367/25, 43, 83; 364/422

[56] References Cited

U.S. PATENT DOCUMENTS 4,642,800 2/1987 Umeda ..... 367/85

OTHER PUBLICATIONS

A. Kyllingstad & G. W. Halsey, "A Study of Slip-Stick Motion of the Bit".

E. Skaugen, "The Effects of Quasi-Random Drill Bit Vibrations Upon Drill String Dynamic Behavior".

*Primary Examiner*—Thomas H. Tarcza

*Assistant Examiner*—Ian J. Lobo

*Attorney, Agent, or Firm*—Fishman, Dionne & Cantor

[57] ABSTRACT

The filtering technique of the present invention cancels or minimizes noise in data signals found to be caused by dynamic variations in the drilling process. It has been discovered that the measurement of surface vibrations in the drill string and their effects on certain drilling equipment such as rotary table torque contains information that can be used to remove some or all of the pressure disturbance caused by these dynamic variations (vibrations). The result of removing some or all of the dynamic variation induced noise from the measurment-while-drilling (MWD) data signal yields a better signal to noise ratio (SNR) and therefore improves decoding of the MWD signal. In accordance with another important feature of the present invention, it has been found that improved SNR results from taking the first derivative with respect to time of the torque measurement. This first derivative measurement more closely resembles the actual disturbance in the standpipe pressure (SPP). In addition, even greater improvements in SNR may be obtained if the torque measurement is processed by a low-pass filter to equalize the effects of the two different channels. In this case, the torque measurement still better approximates the disturbance in the SPP.

20 Claims, 6 Drawing Sheets

STANDPIPE PRESSURE (SPP)
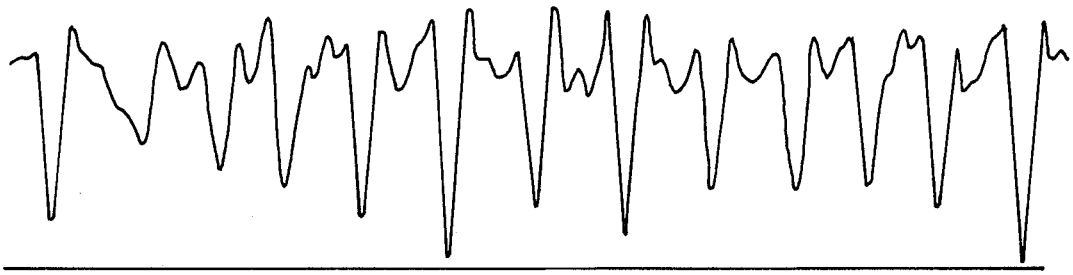
FIG. 3A
TORQUE - CURRENT (RTT)
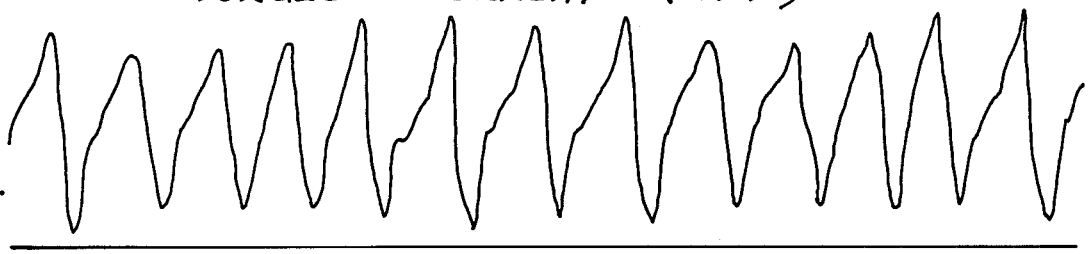
FIG. 3B
PROCESSED TORQUE CURRENT (PRTT)
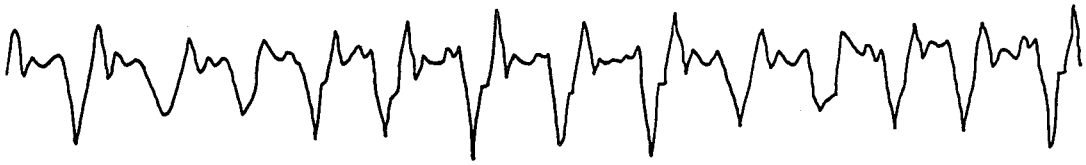
FIG. 3C
ENHANCED STANDPIPE PRESSURE SIGNAL (ESPP)
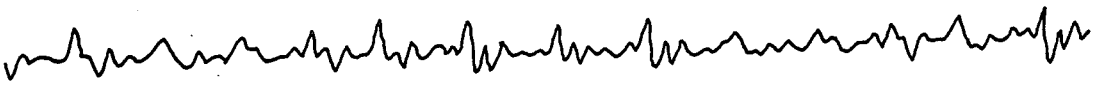
FIG. 3D -22db (11x IMPROVEMENT AFTER SUBTRACTION)

FIG. 6A MWD SIGNAL ENCODED AT THE TRANSMITTER

FIG. 6B MWD SIGNAL AS DETECTED AT THE SURFACE IN THE STANDPIPE (SPP) WITHOUT NOISE

FIG. 6C SSP WITH NOISE

FIG. 6D RTT NOISE REFERENCE

METHOD AND APPARATUS FOR FILTERING NOISE FROM DATA SIGNALS

BACKGROUND OF THE INVENTION:

This invention relates generally to a method and apparatus for filtering periodic and aperiodic noise from a signal having a data component and a noise component. More particularly, this invention relates to a technique of cancelling noise which interferes or otherwise disturbs measurement-while-drilling (MWD) signals obtained during the drilling of subterranean wells.

The mud column in a rotary drill string may serve as the transmission medium for carrying signals of downhole parameters to the surface. This signal transmission is accomplished by the well known technique of mud pulse generation whereby pressure pulses are generated in the mud column which are representative of sensed parameters down the well. The drilling parameters are sensed in a sensor unit in a bottom hole assembly (BHA) near or adjacent to the drill bit. Pressure pulses are established in the mud stream within the drill string, and these pressure pulses are received by a pressure transducer and then transmitted to a signal receiving unit which may record, display and/or perform computations on the signals to provide information on various conditions down the well. The mud pulses may be generated by any of the known measurement-while-drilling (MWD) systems such as disclosed in U.S. Pat. Nos. 3,982,431, 4,013,445 and 4,021,774, all of which are assigned to Teleco Oilfield Services, Inc. of Meriden, Connecticut (assignee of the present invention).

The average pressure measured in the mud column of the drill string or standpipe is known as standpipe pressure or SPP. As a result of the drilling there are many energy sources that disturb the average pressure measured in the standpipe. One such energy source is of course, the signal from the MWD tool itself. As mentioned, this is a pressure modulated digitally encoded signal which communicates information from sensors located near the bit. Unfortunately, other energy sources cause disturbances (e.g. noise) that interfere with the MWD signal. Examples of these are fluctuations caused by the action of the mud pumps, bit bounce and rapid vibration motion of the drill string. These disturbances cause pressure changes that confound the signal from the MWD tool so that the reliability of the decoded MWD information is reduced.

Bit bounce and the rapid motion of the drill string can be related to the dynamic variations in the drilling process itself. One primary source of these vibrations has been identified with the nature of the interaction between the bit and the formation. In SPE PAPER 16660 entitled "The Effects of Quasi-Random Drill Bit Vibrations Upon Drill String Dynamic Behavior" (Sept. 1987), the author states "One of the main sources of drill string vibrations is the interaction between the drill bit and the formation. Downhole measurements of forces and accelerations within the bottomhole assembly have shown that the vibrations at the bit have large quasi-random components, both for axial and rotational movements. These quasi-random vibrations are probably due to uneveness of the formation strength, random breakage of rock, and amplification of these effects by mode coupling . . . ".

It has now been discovered by the inventors herein that the effect of these vibrations are the main cause of offending pressure variations seen in the standpipe and that indirect measurements at the surface can be used to reduce the effect of the offensive pressure variations. One notable pressure disturbance (i.e. source of noise) is a result of axial and torsional vibration that often manifests itself, for example, as a stick/slip action of the bottomhole assembly (BHA). Indicators of these downhole vibrations can be monitored at or near the surface.

This stick/slip phenomenon is described in a paper entitled "A Study of Slip-Stick Motion of the Bit" by A. Kyllingstad and G. W. Halsey, Society of Petroleum Engineers (SPE) Paper 16659, Sept. 1987. As discussed in that paper, torsional oscillations are caused by alternating slipping and sticking of the bottom hole assembly (BHA) as it rotates in the borehole. This phenomenon is associated with a large amplitude, sinusoidial and often saw-tooth like variation in the applied torque. The term slip-stick motion refers to the belief that the amplitude of the torsional oscillations becomes so large that the drillcollar section periodically comes to a complete stop and does not come free until enough torque is built up in the drill string to overcome the static friction.

By observing these phenomena the inventors herein have discovered the following features which result from downhole vibrations such as the stick/slip action of the BHA:

(1) When the vibrations such as the stick-slip action at the bit occurs, hydraulic pressure pulses in the drilling fluid are created that travel to the surface and can be detected in the standpipe.

(2) When the vibrations such as the stick-slip action at the bit occurs, input drive torque rotating the drill string changes and these changes have a relationship to the pulses detected in the standpipe.

(3) The shape and timing of the drive torque measurement is different from the pressure pulses detected in the standpipe. This is because the reflection of the bit torque travels in the steel of the drillpipe while the pressure signal travels in the drilling mud and the channel phase velocities and dispersive effects are quite different. But, if the measurement of the surface signal such as the input drive torque is modified in shape and timing, it can be made to approximate the pulses detected in the standpipe.

It will be readily appreciated that the pressure disturbance created when the stick/slip action occurs causes disruptive noise which is detrimental to the integrity of the MWD signal. Noise cancellation techniques are known which are usually effective for noise reduction and signal to noise ratio (SNR) enhancement. These known techniques include adaptive filters such as the least mean-square (LMS) and the recursive least square (RLS); and are effective when (1) noise reference is available, (2) the noise is periodic, (3) the noise is uncorrelated with the signal to be enhanced; and (4) the noise statistics are changing slowly. Another known noise cancellation technique for periodic and slowly changing noise is disclosed in U.S. Pat. No. 4,642,800.

In the above discussion, bit torque reflected to the surface is measured by monitoring the drive torque to the drill string. Measurement of the torsional accelerations at the surface (at or below the Kelly) will also produce the desired results. If this technique is employed, it would be advantageous to measure the axial accelerations as well. Axial vibrations at the surface are indicative of downhole axial vibrations such as bit bounce which is another source of hydraulic pressure pulses. These pulses also are detectable in the standpipe and hinder the accuracy of pressure pulse MWD data reception. These measurements of surface axial vibration would be treated in a similar manner to cancel the pressure pulse effects of downhole axial vibration. In fact, the stick-slip action is a combination of torsional and axial movements, both of which are reflected in the drive torque. By measuring torsional and axial motion separately, such as can be done with accelerometers, the two components can be separated and treated individually.

SUMMARY OF THE INVENTION:

The above-discussed and other problems and deficiencies of the prior art are overcome or alleviated by the filtering technique of the present invention for cancelling the noise found to be associated with downhole vibration such as the stick/slip action of the BHA. It has now been discovered that the measurement of the rotary table torque contains information so that it can be successfully used as a signal to remove some or all of the pressure disturbance caused by this stick/slip action. This important discovery (e.g. that the measurement of the rotary table torque can be used for cancellation of noise from stick/slip action) has been determined despite the above-discussed shape and timing problems and the fact that the stick/slip action frequency cannot be accurately predicted. The results of removing some or all of the stick/slip noise from the MWD signal yields a better signal to noise ratio (SNR) and therefore improves decoding of the MWD signal.

In accordance with another important feature of the present invention, it has been found that improved SNR results from taking the first derivative with respect to time of the torque measurement. This first derivative measurement more closely resembles the actual disturbance in the standpipe pressure (SPP).

In addition, even greater improvements in SNR may be obtained if the torque measurement is processed by a low-pass filter to equalize the effects of the two different channels. In this case, the torque measurement still better approximates the disturbance in the SPP.

The above-discussed and other features and advantages of the present invention will be appreciated and understood by those of ordinary skill in the art from the following detailed description and drawings.

BRIEF DESCRIPTION OF THE DRAWINGS:

Referring now to the drawings, wherein like elements are numbered alike in the several FIGURES:

FIGS. 3A–3D are graphical representations of SPP, RTT, processed RTT and enhanced SPP, respectively;

Figure 1:
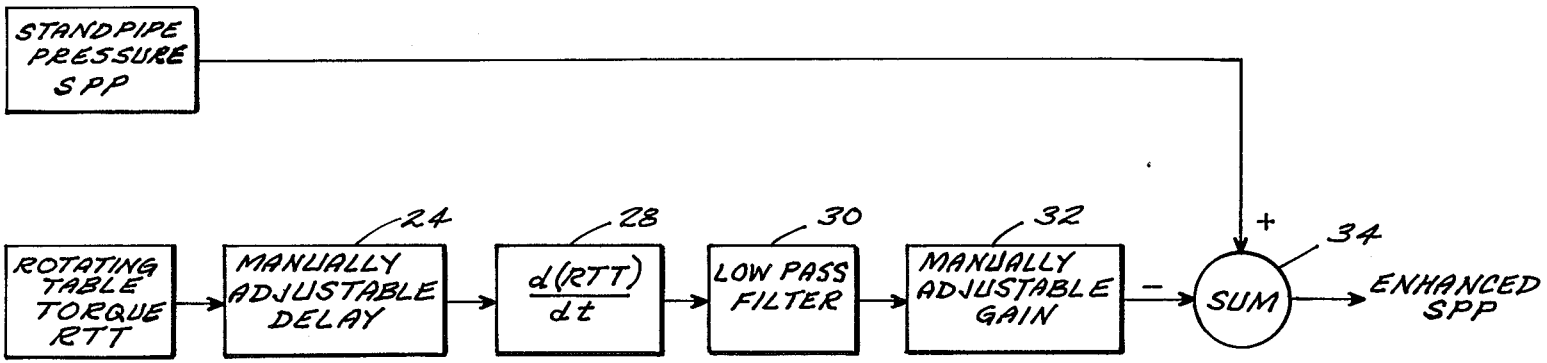
FIG. 1 is a block diagram of the method for cancelling periodic and aperiodic noise in accordance with the present invention.

DESCRIPTION OF THE PREFERRED EMBODIMENT:

Referring first to FIG. 1, a block diagram showing a preferred embodiment of the method and apparatus for cancelling periodic and aperiodic noise in a MWD pressure pulse signal is shown. (FIG. 1 will now be discussed only briefly, with more detailed descriptions occurring hereinafter). Two input signals are utilized. The first input signal is the pressure signal picked up in the standpipe containing digitally coded pressure modulation MWD data from a downhole MWD tool and will be referred to hereinafter as SPP. The second input signal is the measurement of torque that drives the rotary table on the drill rig floor (and hence rotates the drill string in the borehole) and will be referred to hereinafter as RTT. It will be appreciated that while several methods are available for measuring torque on the drill string, one preferred method of torque measurement is accomplished by monitoring the rotary drive motor current which is directly proportional to torque. Yet another method is with an accelerometer mounted at or near the Kelly to detect torsional accelerations.

Figure 2:
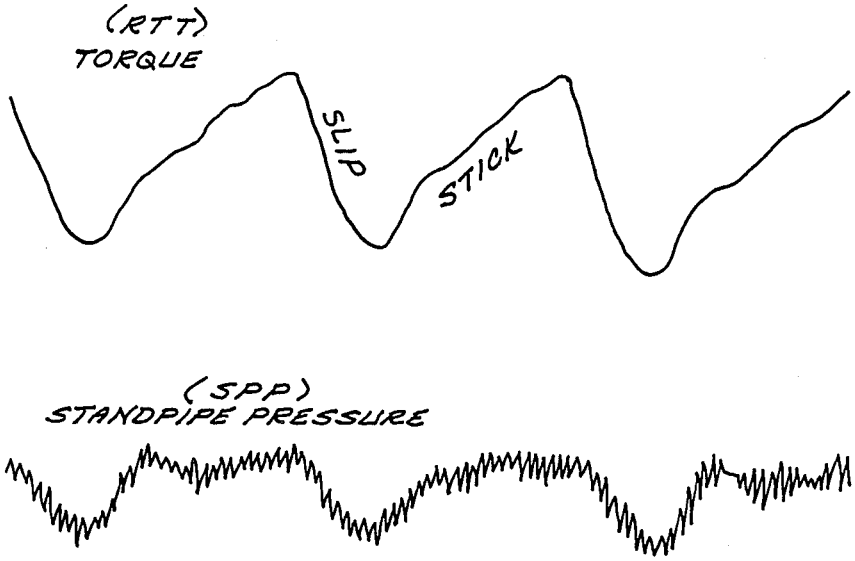
FIG. 2 is a graph comparing rotary table torque (RTT) measurement to standpipe pressure (SPP) measurement.

The effect of the stick/slip action of the bottom hole assembly (BHA) is very clearly shown in FIG. 2 which is actual data comparing rotary table torque (RTT) measurement and standpipe pressure (SPP) measurement. Each time the bit breaks free and spins forward (slips), a negative pulse is measured in the SPP. The slip calls for reduced rotary table torque and this is reflected by the sharp negative dip in the rotary table torque measurement (RTT). Careful examination will show that shapes, amplitudes, and timing are not well enough behaved (RTT does not look enough like SPP) for a direct subtraction of RTT from SPP to precisely cancel all of the noise (although direct subtraction may be adequate for less demanding situations).

While clearly not preferred, it has been found that direct subtraction of properly scaled and delayed torque (RTT) from the standpipe pressure signal by manual means will work under some mild cases. While direct subtraction methods for filtering noise have been known per se, because of the discovery by the inventors herein of the indirect relationship between torque signal and noise on SPP, it is believed that the subtraction method described above is an important novel feature of the present invention. Turning to FIG. 1, such a subtractive method calls for the subtraction of the data in FIG. 3B (RTT) from the data in FIG. 3A (SPP). Note that in the graphs of FIG. 3, for convenience and clarity, there are not MWD data present in the illustrated time frame.

Figure 4:
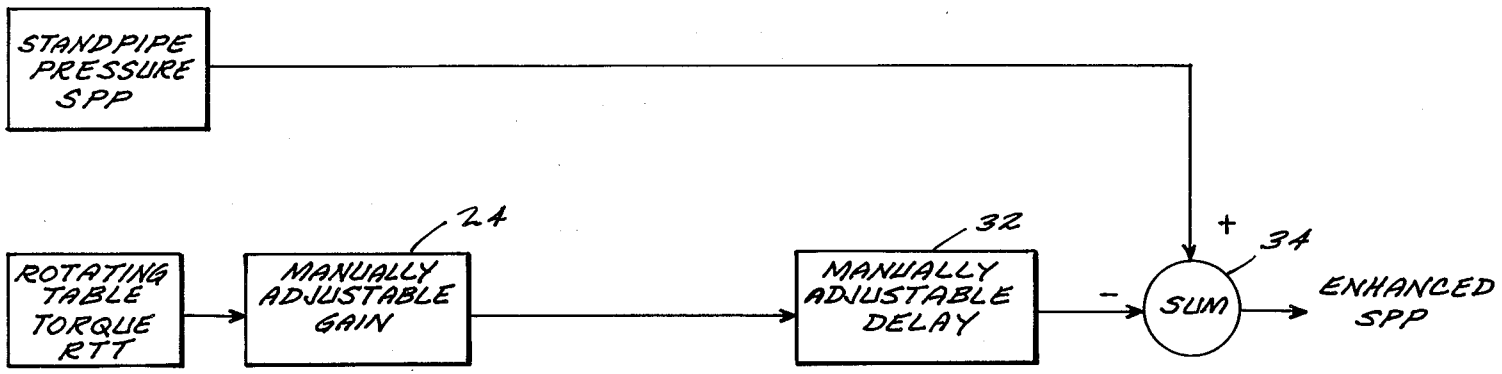
FIG. 4 is a block diagram of a method of noise cancellation by subtracting a modified RTT from SPP.

FIG. 4 is a block diagram depicting a simple method and apparatus for practicing the subtraction of the RTT from the SPP in accordance with the most basic feature of the present invention. As shown in FIG. 4, rotary table torque (RTT) on the drill string (measured as a function of the rotary drive motor current) is measured and processed by known signal processing techniques including manual adjustable gain and manual adjustable delay. Standpipe pressure SPP is also measured in a known manner. Thereafter, these respective RTT and SPP signals are subtracted to provide a signal having reduced noise caused by the downhole vibration such as the stick/slip phenomenon. The subtraction step is illustrated in the preferred embodiment as item 34 in FIG. 1.

As mentioned, the subtraction method discussed above will provide adequate results only under some mild cases of torque. However, for more accurate noise cancellation in more demanding situations, the present invention provides several methods of enhancing the RTT signal. Turning again to FIG. 3, a rotary table torque RTT as monitored by measuring the drive motor current is depicted in FIG. 3B (of course, any other appropriate torque measurement means would work). It will be appreciated that curve 3B appears similar to the negative pressure pulses caused by BHA stick/slip action. As mentioned above, if subtracted after appropriate scaling and delaying, an improvement in MWD signal to noise ratio (SNR) will be achieved. However, if the first derivative of this signal is taken before subtraction, then a much improved SNR is achieved. The first derivative is equivalent to the slope of the signal at a given point n. That is, d/dt at point n=((Value(n)−Value(n)−1))/ (t(n)−t(n−1 )). Applying this equation to FIG. 3B, the resultant curve will be FIG. 3C. This trace (FIG. 3C) more clearly represents the disturbance from BHA stick/slip relative to the measured torque trace of FIG. 3B and represents a first enhancement of the RTT signal in accordance with the present invention.

Figure 5:
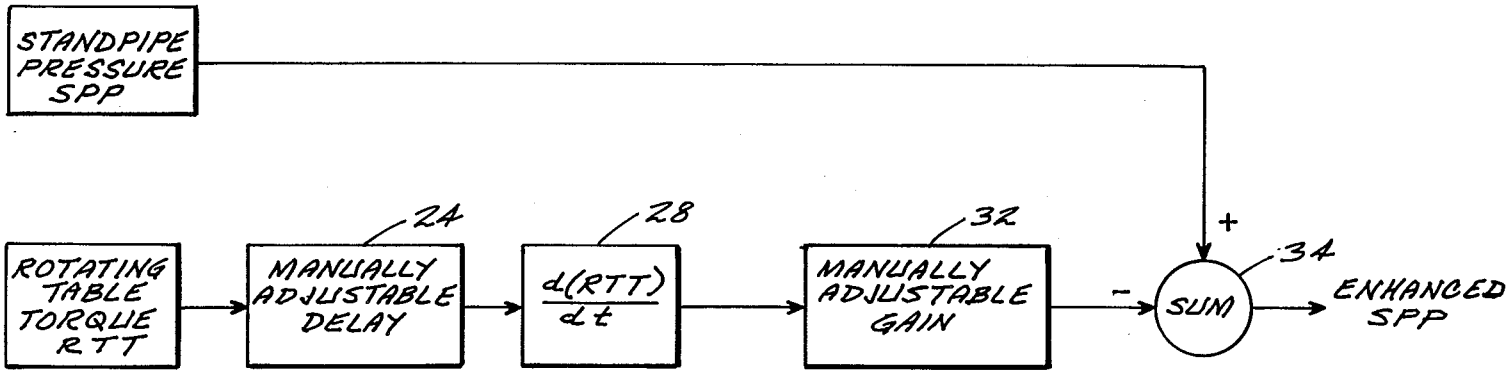
FIG. 5 is a block diagram of a method of noise cancellation by subtracting the derivative of RTT from SPP.

FIG. 5 is a block diagram depicting the enhanced noise cancellation method of the present invention wherein the first derivative of RTT is subtracted from SPP. It will be appreciated that the components of FIG. 5 are similar to those of FIG. 4 with the addition of the first derivative being taken of the processed RTT signal prior to being subtracted from the SPP signal. The step of taking the first derivative is illustrated in the preferred embodiment as item 28 in FIG. 1.

A second enhancement or improvement to the RTT signal is the equalization of the shape of the torque signal so that it looks still more like the disturbance in the SPP signal. As discussed, the pressure disturbance traveling up through the drillpipe mud is dispersed by the mud characteristics whereas the torque is transmitted by the drillpipe steel. The mud filters the pressure disturbance more than the torque is filtered by the steel. Therefore, it was discovered that by adding a low pass filter, see FIG. 1, to the torque signal, such as a resistor capacitor combination, (for example, an $F_o$ of 0.1 Hz), the d/dt torque pulses will become rounded and better reflect the SPP disturbance. The low pass filter is illustrated in the preferred embodiment as item 30 in FIG. 1.

In accordance with the referred embodiment of the present invention, the gain of the torque signal, RTT, is adjusted by eye on a strip chart so that the valleys in the torque derivative are similar in amplitude to the valleys in the standpipe pressure signal, SPP. Other known methods of gain adjustment can also be used.

In a similar fashion, after gain is adjusted, the delay of the torque signal, RTT, is adjusted so that the valleys in the torque derivative align with the corresponding valleys in the standpipe pressure signal, SPP.

After the torque is processed as recommended above, the time shifted RTT signal is subtracted from the SPP The result is shown in FIG. 3D. In this example, the SNR has been improved by an extraordinary 11 times.

The present invention will now be discussed with respect to an actual MWD signal.

Figure 6:
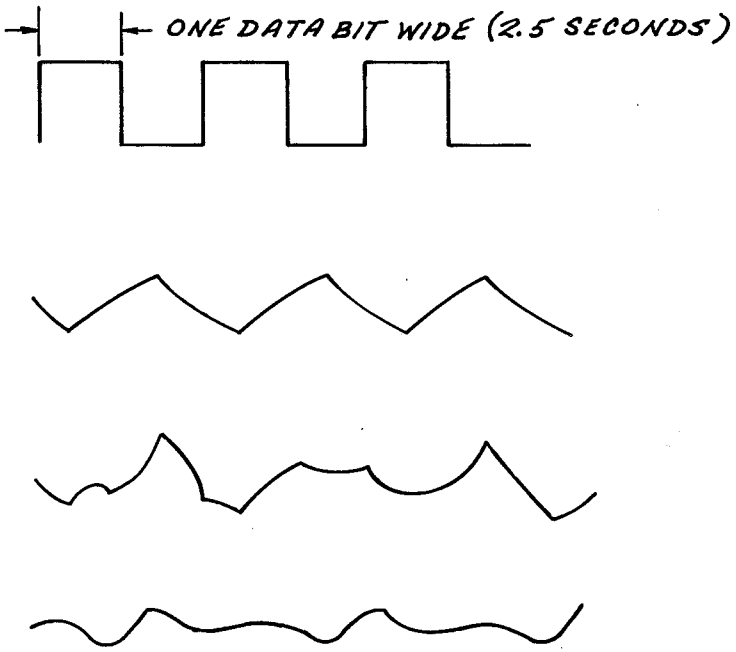
FIGS. 6A–6D are graphical representations of SPP with MWD signals.

FIG. 6A illustrates the MWD signal as it is encoded by the MWD transmitter. The rise and fall of pressure created by the transmitter's variable orifice (see aforementioned Patent Nos. 3,982,431, 4,013,445 and 4,021,774), encodes a binary message of ones and zeros. A self-locking code, biphase level, is used. FIG. 6B illustrates how the MWD signal is integrated by the drilling fluid as it travels to the surface as a series of pressure pulses. FIG. 6C shows this signal with corruption such as may be induced when the bit grabs and releases in the formation. FIG. 6D illustrates a measurement that can be made at the surface that contains sufficient information to make an improvement in the MWD signal decodability when processed as described by the present invention. This improvement is measured by the change in the signal to noise ratio (SNR) present in the signal as delivered to the MWD decoder.

Figure 7:
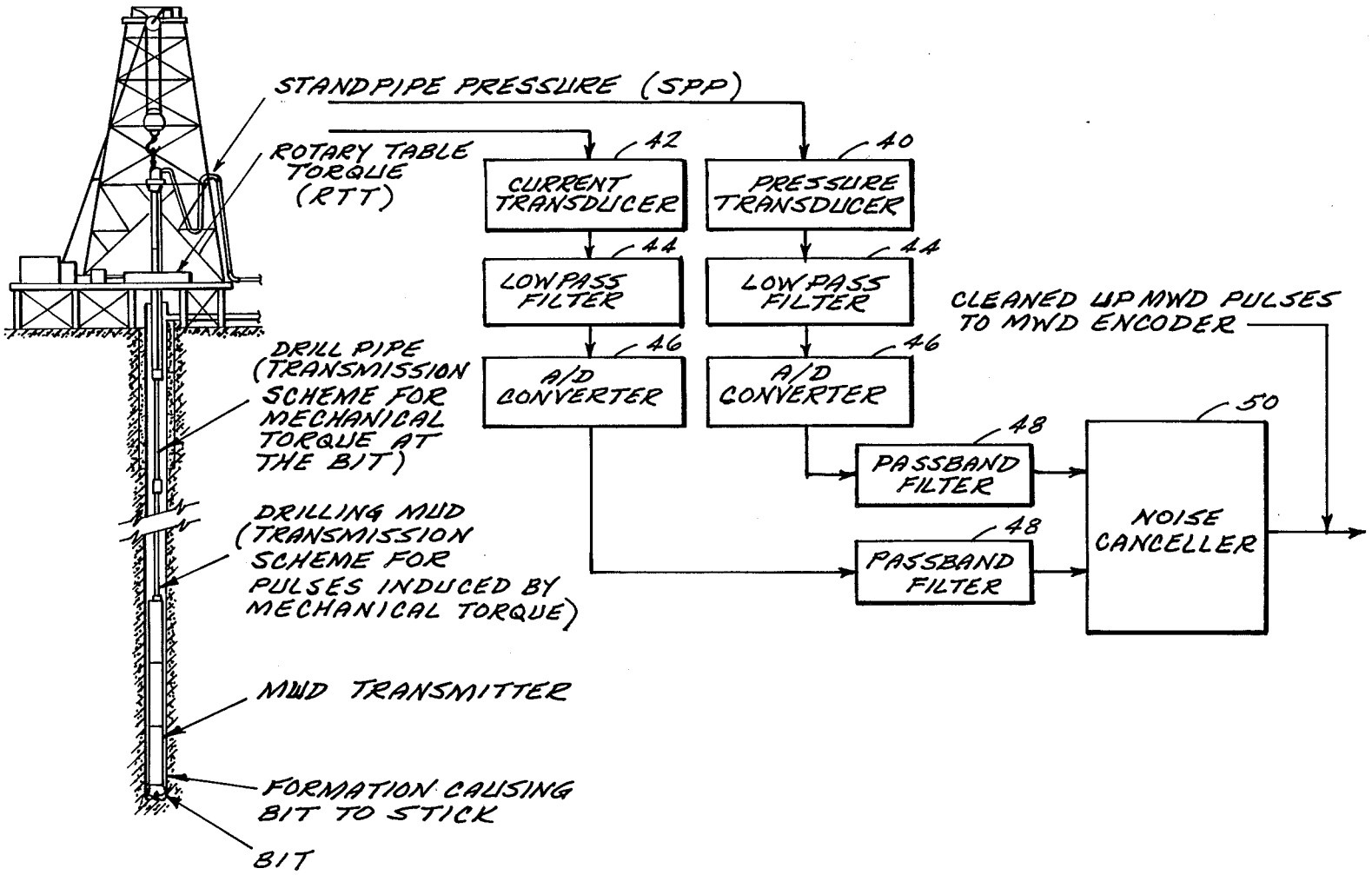
FIG. 7 is a schematic diagram of the noise canceler of the present invention used with MWD signals.

FIG. 7 is a diagram of how the MWD pressure (SPP) and the noise reference signal e.g., rotary table torque (RTT) signals are processed for noise cancellation. Both signals are processed identically so as to preserve their phase relationships. The pressure signal is detected by a strain gauge transducer 40 such as the P/N BF-5,000 PSIG manufactured by Data Instrument Inc. of Acton, Massachusetts. The torque is detected by an inductive couple device 42 such as manufactured by Ohio Semitronics Inc. of Columbus, Ohio, part number CT-21825A.

Each signal is passed through a low pass filter 44, 3 db point at 50 Hz, and then sampled by an analog to digital converter 46 at 100 times a second and stored in a register. The sampled signal is then band passed a 48 to remove all energy outside the band (from 0.01 Hz to 0.6 Hz) containing the MWD coded information using a known algorithm. After these processes, the SPP and RTT signals are ready to be processed by the noise canceler 50 of the present invention shown in FIGURE 1. After the signal is processed by the noise canceler 50, the resulting signal is decoded in the normal fashion for MWD, such as zero crossing detection.

As mentioned, the preferred embodiment of the noise canceler 50 of the present invention is shown in the block diagram of FIG. 1. The two signals, SPP (the MWD signal to be enhanced) and RTT (the reference for the interfering noise) are introduced to this device and exit to the decoder as shown in FIG. 7. Referring to FIG. 1, the manner in which the overall device works is as follows:

The samples of RTT are shifted into a buffer 24, at 1 sample each 0.01 seconds. The buffer which is 2 MWD bit widths long, that is 5 seconds, is set up as a variable length delay line. The amount of delay manually is controlled by the operator through a keyboard entry.

RTT is then differentiated at 28, filtered at 30, gain adjusted through operator keyboard entry at 32, and finally subtracted from the SPP at 34. Filter 30 is a low pass filter with a 3 db point at 0.5 Hz.

The above implementation discusses the removal of noise generated by torsional vibrations such as the stick-slip action of the bit and uses the rotary table torque measurement. In exactly the same manner, noise generated by axial movement of the bit and drill string can be reduced or eliminated by monitoring the axial motion of the drill string at the surface by using an axial mounted accelerometer. Although other techniques are known for measuring the axial vibrations, the implementation is the same. In addition, even improved results may be achieved when the measured torsional and axial accelerations are combined to define a combined reference signal.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of filtering noise from a data signal that is telemetered through well drilling fluid in a rotary drill string comprising the steps of:

measuring vibration on the drill string at or near the surface to define a reference signal;

measuring the standpipe pressure of the drilling fluid in the drillstring to define a standpipe pressure (SPP) signal; and subtracting the reference signal from said SPP to define a data signal having improved signal to noise ratio.

2. The method of claim 1 wherein:

said step of measuring surface vibration includes the step of measuring the torsional vibration on the drill string.

3. The method of claim 2 wherein drive motor means actuates rotary table means for rotating the drill string and wherein said torsional vibration measuring step comprises:

measuring the current of said drive motor means.

4. The method of claim 1 including:

determining the first derivative of the reference signal to define an enhanced reference signal; and subtracting the enhanced reference signal from said SPP.

5. The method of claim 1 including:

filtering the reference signal to equalize the shape of the reference signal to the shape of the SPP signal.

6. The method of claim 4 including:

filtering the reference signal to equalize the shape of the reference signal to the shape of the SPP signal.

7. The method of claim 5 wherein:

said filtering step utilizes a low pass filter.

8. The method of claim 6 wherein:

said filtering step utilizes a low pass filter.

9. The method of claim 1 wherein:

said step of measuring surface vibration includes the step of measuring the axial vibration on the drill string.

10. The method of claim 1 wherein said step of measuring surface vibration includes the steps of:

measuring the torsional and axial vibrations on the drill string; and combining said measured torsional and axial vibrations to define said reference signal.

11. An apparatus for filtering noise from a data signal that is telemetered through well drilling fluid in a rotary drill string comprising:

means for measuring vibration on the drill string at or near the surface to define a reference signal;

means for measuring the standpipe pressure of the drilling fluid in the drillstring to define a standpipe pressure (SPP) signal; and means for subtracting the reference signal from said SPP to define a data signal having improved signal to noise ratio.

12. The apparatus of claim 11 wherein:

said means for measuring surface vibration includes torsional vibration measuring means for measuring the torsional vibration on the drill string.

13. The apparatus of claim 12 wherein drive motor means actuates rotary table means for rotating the drill string and wherein said torsional vibration measuring means comprises:

means for measuring the current of said drive motor means.

14. The apparatus of claim 11 including:

means for determining the first derivative of the reference signal to define an enhanced reference signal; and means for subtracting the enhanced reference signal from said SPP.

15. The apparatus of claim 11 including:

filtering means for filtering the reference signal to equalize the shape of the reference signal to the shape of the SPP signal.

16. The apparatus of claim 14 including:

filtering means for filtering the reference signal to equalize the shape of the reference signal to the shape of the SPP signal.

17. The apparatus of claim 15 wherein:

said filtering means comprises low pass filter means.

18. The apparatus of claim 16 wherein:

said filtering means comprises a low pass filter means.

19. The apparatus of claim 11 wherein:

said means for measuring surface vibration includes means for measuring the axial vibration on the drill string.

20. The apparatus of claim 11 wherein said means for measuring surface vibration includes:

means for measuring the torsional and axial vibrations on the drill string; and means for combining said measured torsional and axial vibrations to define said reference signal.

* * * * *